US007008130B1

(12) United States Patent
Hill

(10) Patent No.: US 7,008,130 B1
(45) Date of Patent: Mar. 7, 2006

(54) WINDOW WASHING TOOL

(76) Inventor: Samuel M. Hill, 2598 Ramblewood Dr., Kalamazoo, MI (US) 49009

( * ) Notice: Subject to any disclaimer, the term of this patent is extended or adjusted under 35 U.S.C. 154(b) by 0 days.

(21) Appl. No.: 11/154,587

(22) Filed: Jun. 17, 2005

(51) Int. Cl.
*A47L 1/08* (2006.01)
*A47L 13/12* (2006.01)
*A46B 11/06* (2006.01)

(52) U.S. Cl. ..... 401/27; 401/25; 401/289

(58) Field of Classification Search ..... 401/25, 401/26, 27, 289, 261, 263
See application file for complete search history.

(56) References Cited

U.S. PATENT DOCUMENTS

| | | | | |
|---|---|---|---|---|
| 556,722 A | | 3/1896 | Ford | |
| 832,475 A | * | 10/1906 | George | 401/15 |
| 1,093,114 A | * | 4/1914 | Corbett | 401/137 |
| 1,498,246 A | * | 6/1924 | Spencer | 401/270 |
| 1,598,742 A | * | 9/1926 | Parker | 401/10 |
| 1,783,506 A | | 12/1930 | HoMiller | |
| 2,818,593 A | * | 1/1958 | Klingler | 401/263 |
| 3,837,747 A | | 9/1974 | Seymore | |
| 4,778,298 A | | 10/1988 | Shin et al. | |
| 4,871,275 A | | 10/1989 | Aldous | |
| 4,944,623 A | | 7/1990 | McNeil | |
| 5,271,682 A | | 12/1993 | Realdon | |
| 5,364,198 A | | 11/1994 | Skenderi | |
| D357,098 S | | 4/1995 | Caligiuri | |
| 5,725,322 A | * | 3/1998 | Evans | 401/42 |
| 5,735,620 A | | 4/1998 | Ford | |
| 5,769,324 A | | 6/1998 | Lenhart | |
| 5,819,365 A | | 10/1998 | Huffman et al. | |
| 6,250,831 B1 | | 6/2001 | Craven | |
| 6,257,786 B1 | | 7/2001 | Thomas | |
| 6,413,002 B1 | | 7/2002 | Delaine, Jr. | |

(Continued)

FOREIGN PATENT DOCUMENTS

DE 43 03 113 A1 8/1994

OTHER PUBLICATIONS

"Professional Window Washing Products," http://www.mr-longarm.com/prowline.html, 8 pages printed from the Internet on May 13, 2005.

(Continued)

*Primary Examiner*—David J. Walczak
(74) *Attorney, Agent, or Firm*—Richard C. Litman

(57) ABSTRACT

The window washing tool is a tool for washing windows located high above ground without requiring the use of ladders or scaffolding. The window washing tool has an extension handle which serves as both a reach extension device allowing reaching high windows from the ground, and for supplying water and cleaning solution to a washing head. The washing head holds the implements used to clean the window. The extension handle has a plurality of sections, which are connected together to provide the required length. The extension handle is hollow and conducts water supplied at pressure to the lower end of the extension handle to the washing head at the top of the extension handle. A lower section of the extension handle includes a shutoff valve for controlling the flow of water to the washing head, and a reservoir for introducing cleaning solution into the flow of water.

10 Claims, 5 Drawing Sheets

U.S. PATENT DOCUMENTS

| | | | |
|---|---|---|---|
| 6,419,415 | B1 | 7/2002 | Vosbikian et al. |
| 6,692,171 | B1 | 2/2004 | Vito |
| 6,702,497 | B1 | 3/2004 | Tien |
| 6,726,388 | B1 | 4/2004 | Monahan |
| 6,808,332 | B1 | 10/2004 | Demuth et al. |
| 2003/0071142 | A1 | 4/2003 | Pohorecki |
| 2004/0146333 | A1 | 7/2004 | Fu |
| 2004/0234327 | A1 | 11/2004 | Demuth et al. |

OTHER PUBLICATIONS

Telescoping Fiberglass Extension Poles for Window Washing http://www.excelsails.com/telescopingextension-poles.htm, 8 pages, printed from Internet on May 13, 2005.

* cited by examiner

WINDOW WASHING TOOL

BACKGROUND OF THE INVENTION

1. Field of the Invention

The present invention relates to cleaning tools, and in particular to a window washing tool for cleaning windows.

2. Description of the Related Art

Building windows require periodic cleaning to preserve a pleasing appearance. Because the windows are transparent glass, it is important that the cleaning process leave the glass surface free of debris and residues that may cause streaking. The traditional method for achieving this high degree of cleanliness is to scrub the window with a cloth, sponge, brush, or other scrubbing implement using a detergent, and to then squeegee the window dry, so that any dissolved or suspended detergent or debris is removed, rather than being allowed to dry to a film.

Large buildings may contain a large number of glass windows, and cleaning these windows is a labor intensive operation. Compounding the laboriousness of the task is the problem of cleaning windows located above the ground floor of the building. Reaching these high windows for cleaning requires the use of ladders or scaffolding. When ladders are used, the ladders must be repeatedly moved during cleaning, requiring cleaning personnel to descend and reposition the ladder. Scaffolding requires time and labor to setup and must be inspected and maintained to ensure that it is safe for personnel to use. Both ladders and scaffolding require cleaning personnel to work at elevated heights, thus exposing the cleaning personnel to the risk of injury or death from falling.

An exemplary device for cleaning windows is described in German Patent No. 4,303,113, published Mar. 20, 2003, which discloses a window washing system with a spray nozzle for use in washing automobile windows. The disclosed device is indicative of the art for cleaning windows, but does not disclose a device similar to the claimed invention.

Thus, a window washing tool solving the aforementioned problems is desired.

SUMMARY OF THE INVENTION

The window washing tool is a tool for washing windows located high above ground without requiring the use of ladders or scaffolding. The window washing tool has an extension handle that serves as both a reach extension device allowing reaching high windows from the ground and as a means for supplying water and cleaning solution to a washing head. The washing head supports the implements used to clean the window.

The extension handle may comprise a plurality of sections, which are connected together to provide the required length. Alternatively, the extension handle may comprise one or more telescoping sections. The extension handle is hollow and conducts water supplied at pressure to the lower end of the extension handle to the washing head at the upper head of the extension handle. A lower section of the extension handle includes a shutoff valve for controlling the flow of water to the washing head and a reservoir for introducing cleaning solution into the flow of water.

The reservoir is attached to the lower portion of the extension handle. The reservoir is connected to the extension handle through a valve, such as a stopcock, for controlling the introduction of cleaning solution during cleaning. The reservoir control valve and the water shutoff valve are located near the lower end of the extension handle so that they are accessible during use of the cleaning tool.

The cleaning tool is provided with a washing head. The washing head is connected to the upper end of the extension handle. The washing head has a manifold, which receives the flow of water from the extension handle and distributes the water flow to a plurality of jets. The jets increase the velocity of water to create a spray and direct the flow of water onto a window being cleaned. Mounted on the face of the manifold containing the jets is a fixture for holding a cleaning implement, such as a brush, sponge, cloth or other cleaning implement. A squeegee is attached to the reverse side of the manifold.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
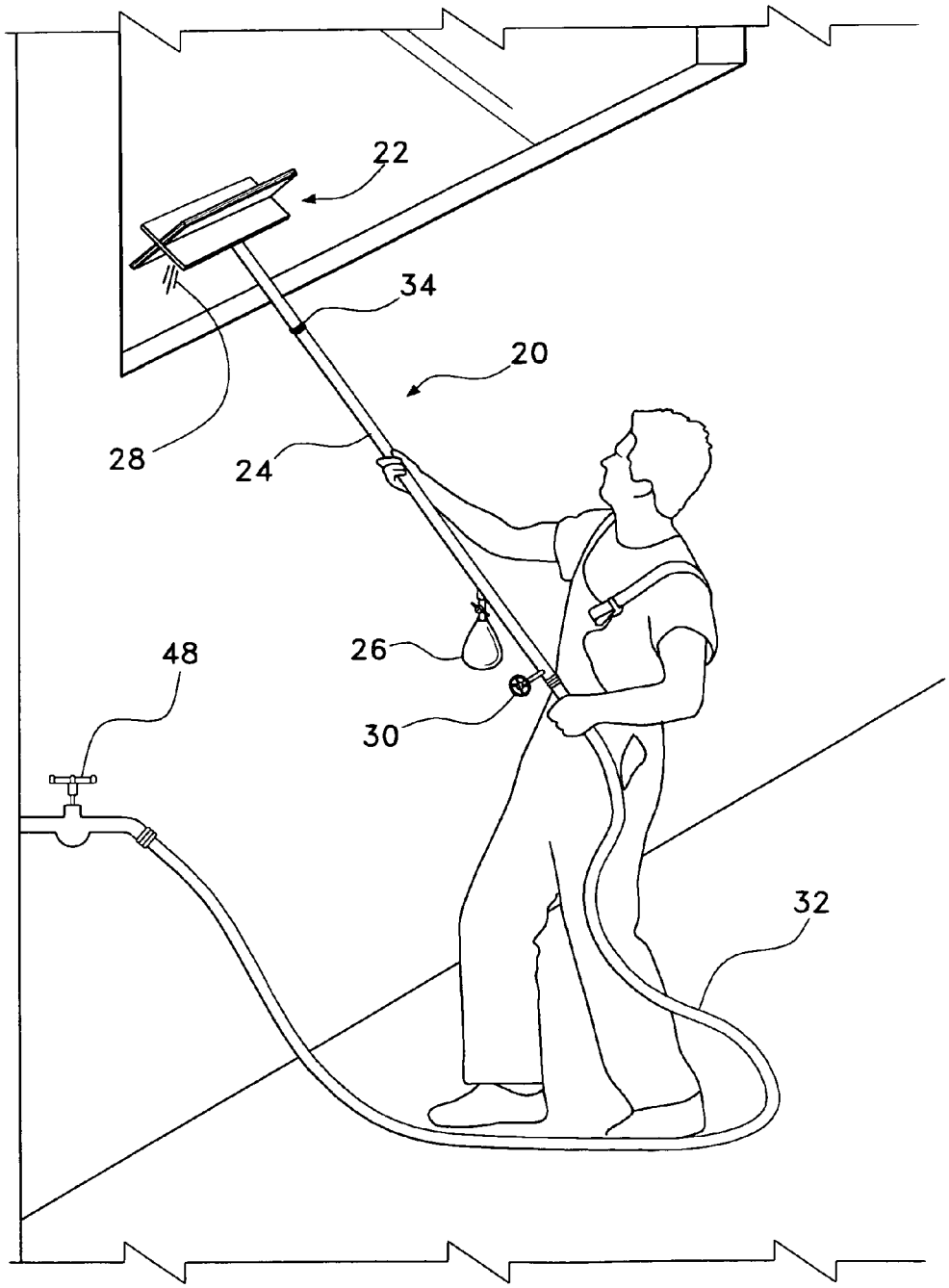
FIG. 1 is an environmental, perspective view of a window washing tool according to the present invention.
Figure 2:
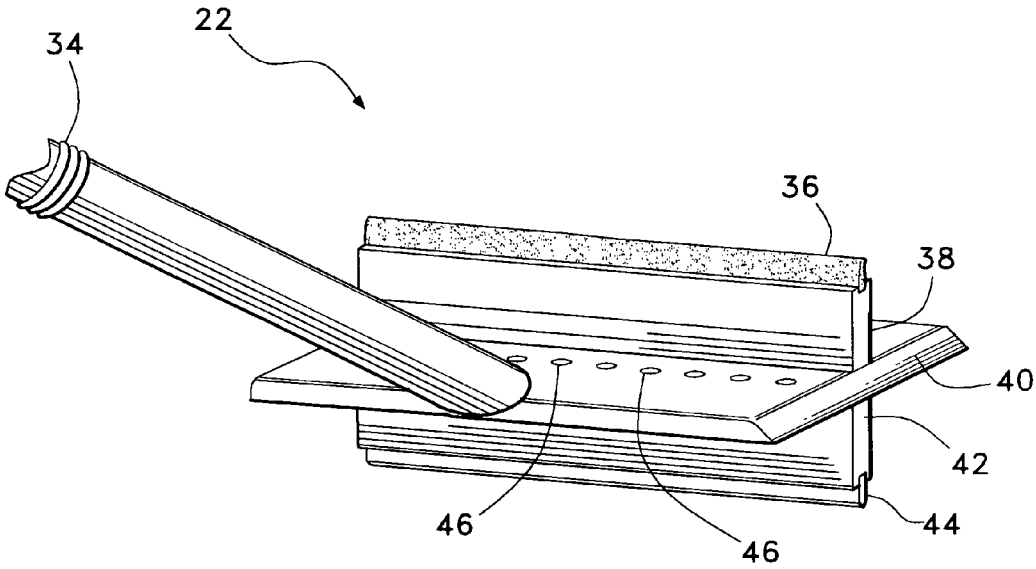
FIG. 2 is a perspective view of the window washing tool of the present invention fragmented to show the spray manifold.
Figure 3:
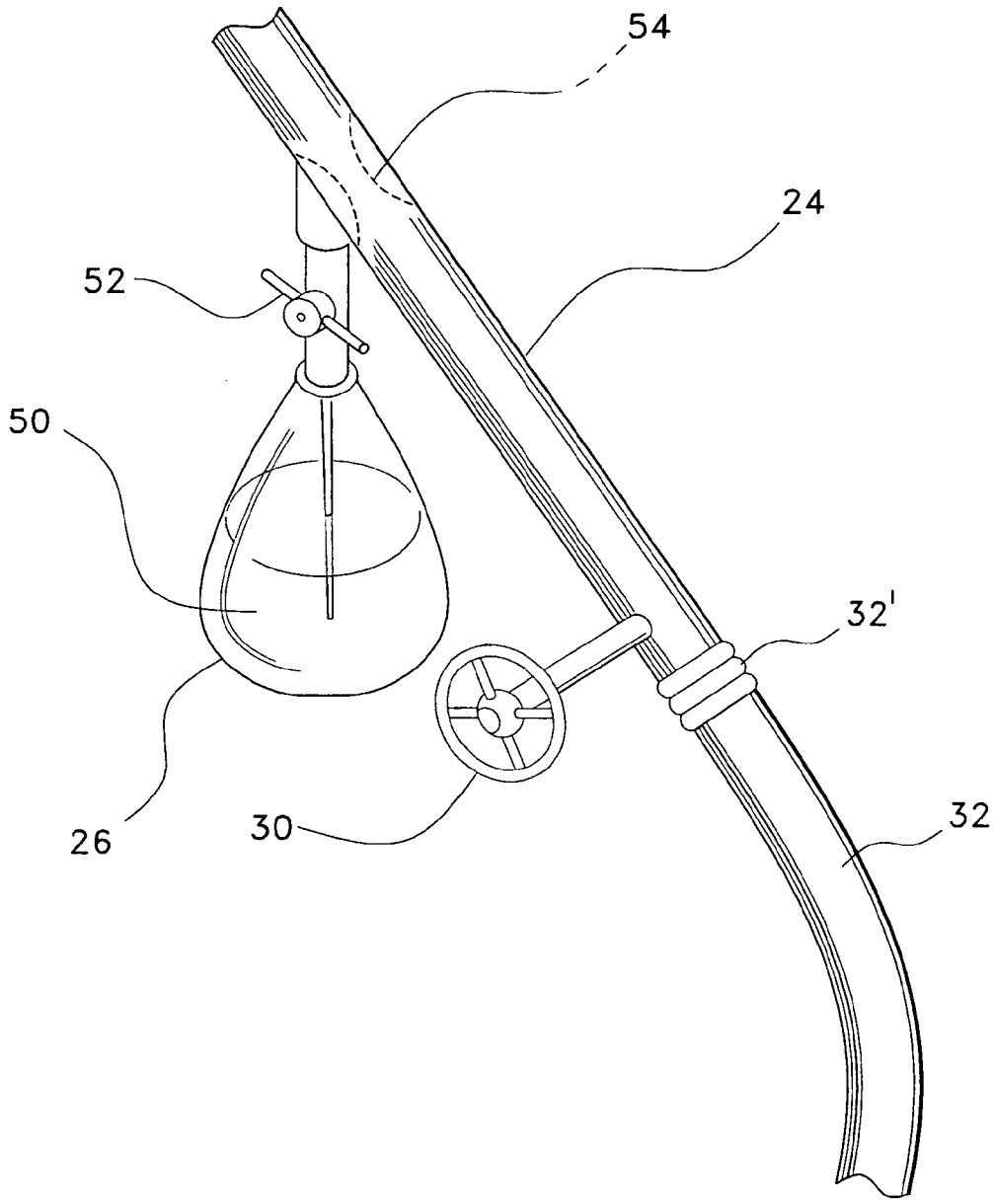
FIG. 3 is a perspective view of a portion of the window washing tool of the present invention, showing a cleaning solution reservoir and shutoff valve.

The present invention is a window washing tool for washing windows located high above the ground. FIGS. 1–3 show the details of a first embodiment of a window washing tool in accordance with the invention.

FIG. 1 shows an operator on the ground using the windowing washing tool 20 to clean the glass of a second story window. The window washing tool 20 is connected to a water supply, such as a faucet 48, by a hose 32, via a removable type connector, such as a threaded connection 32'. A shutoff valve 30 is provided on the window washing tool 20 to allow the operator a convenient control over the water flow through the window washing tool 20.

The window washing tool comprises a washing head 22, and an extension handle 24. The extension handle 24 allows the operator to wash windows located above the ground without having to work from a ladder or from scaffolding. The extension handle 24 also conducts water from the faucet 48 up to the washing head 22. The handle 24 may be made up of sections of piping joined together by threaded or solvent-based connectors 34. Preferably, the piping is a strong, lightweight material, such as aluminum or polyvinyl chloride (PVC). The connectors 34 are preferably of a removable type, such as a threaded union, so that the window washing tool 20 can be disassembled into components of a size convenient for storage. Alternatively, the extension handle 24 may be of a hollow telescoping construction and can be collapsed for convenient storage when not in use.

The maximum effective height by the device is limited by the water pressure available at the water supply. FIG. 1 shows water being supplied through a faucet 48 connected to the municipal water supply system. Typical water pressures from a municipal water supply system might range from thirty to sixty psig. This range of pressures is sufficient for effective cleaning of windows at heights of at least thirty feet above the ground.

FIG. 3 shows details of a lower section of the extension handle 24. The lower section of the extension handle includes the shutoff valve 30, and a cleaning solution reservoir 26.

The shutoff valve 30 allows the operator to shut off water to the washing tool during a cleaning operation. The shutoff valve 30 may be any conventional type of valve. The shutoff valve 30 may be a throttle-type valve, permitting the operator to control the flow rate of water to the washing head 22 in order to control the force of a water spray 28 onto a window during washing. The shutoff valve 30 may be a butterfly valve. Butterfly valves have good throttling properties and can go from fully open to fully closed using by turning the valve handle through a 90° angle.

The cleaning solution reservoir 26 is used to provide a source of cleaning solution 50 to the window washing tool. When the tool 20 is being used to wash windows, a cleaning solution 50, such as ammonia or other commercial window washing liquid, is placed into the reservoir 26. If the tool is used for cleaning surfaces other than glass, solutions appropriate for cleaning the particular surface may be provided. The reservoir 26 is connected to the extension handle 24 through a solution control valve, such as a stopcock 52. The solution control valve 52 allows the operator to control the flow of solution 50 to the washing head 22. The flow of solution can be throttled to provide the proper mixture at the washing head 20, or the flow may be cut off completely.

During operation, solution 50 from the reservoir 26 is drawn into the stream of water flowing through the extension handle 24 by the decreased pressure generated by the flow of water past the solution throttle valve. An internal nozzle 54 or other constriction may be provided in the pipe forming the extension handle 24 to increase the pressure drop, and thus increase the resulting flow of solution 50 from the reservoir 26.

FIG. 2 shows the details of a first embodiment of a washing head 22 in accordance with the invention. The washing head 22 holds the implements used to perform the cleaning of the windows. The washing head 22 comprises a spray jet manifold 40, a cleaning brush holder 38, and a squeegee blade holder 42.

The spray jet manifold 40 connects to the extension handle 24 and receives water and cleaning solution. The spray jet manifold 40 distributes the liquid to one or more jets 46 located on the upper surface of the manifold 40 and through which the liquid sprayed onto a window during a cleaning. The jets 46 increase the velocity of the liquid by forcing the liquid through an aperture with a small cross section. The resulting high velocity jet spray 28 contributes to the effectiveness of the cleaning action of the tool.

The manifold 40 supports the cleaning brush support 38 and the squeegee blade support 42. The cleaning brush support 38 is on the same surface of the manifold as the jets 46. Attached to the cleaning brush holder 38 is a cleaning implement 36, such as a cloth, sponge, brush or other implement for scrubbing the windows. The implement may be secured to the cleaning brush support 38 using any means known in the art, including clamps, adhesives, screws, etc.

The squeegee blade support 42 is mounted on the surface of the manifold 40 opposite from that of the cleaning brush support 38. The squeegee blade support 42 holds a squeegee blade 44 for removing liquid from the surface of a window after the window has been sprayed and scrubbed. The squeegee blade 44 may be held in place on the squeegee blade support 42 by any appropriate means, including friction fit into a groove on the top of the squeegee blade support 42, clamps, screws or adhesives. Preferably, the attachment method permits removing and replacing the squeegee blade 44 when the blade has become worn.

Figure 4:
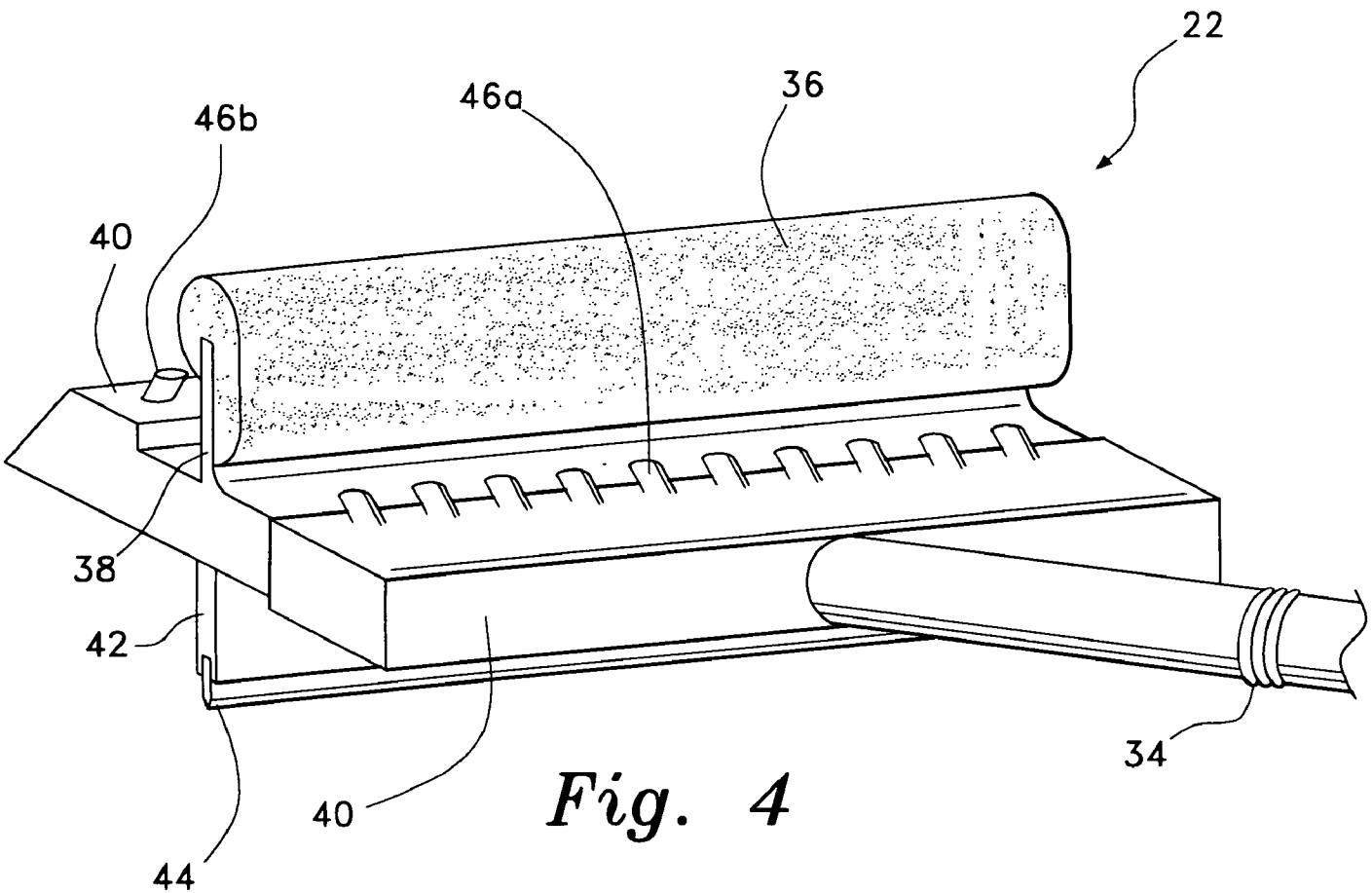
FIG. 4 is a front perspective view showing an alternative embodiment of a washing head for a window washing tool according to the present invention.
Figure 5:
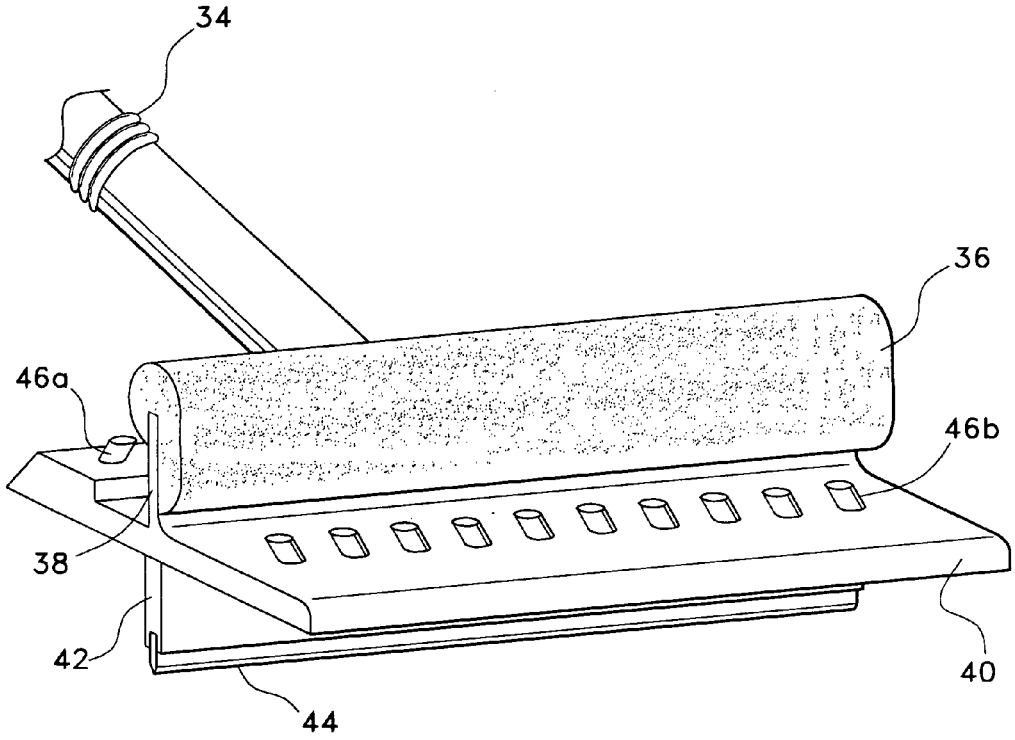
FIG. 5 is a rear perspective view of the alternative washing head of FIG. 4.

FIGS. 4 and 5 show an alternative embodiment of a washing head 22 in accordance with the invention.

The washing head 22 of the alternative embodiment comprises a spray jet manifold 40, a cleaning brush holder 38, and a squeegee blade holder 42.

The spray jet manifold 40 connects to the extension handle 24 and receives water and cleaning solution. The spray jet manifold 40 distributes the liquid to one or more jets 46 located on the upper surface of the manifold 40 and through which the liquid is sprayed onto a window during the window cleaning process. The jets 46 are grouped into a plurality of rows. A first row of jets 46*a* is located ahead of the cleaning brush holder 38. The first row of jets 46*a* is angled so that the spray strikes the window be cleaned just ahead of the cleaning brush holder 38. A second row of jets 46*b* is located behind the cleaning brush holder 38. The jets of the second row 46*b* are preferably directed at right angles to the manifold 40.

The cleaning brush support 38 is on the same surface of the manifold 40 as the jets 46. Attached to the cleaning brush holder 38 is a cloth, sponge, brush or other implement 36 for scrubbing the windows. The cloth, brush, or sponge may be secured to the cleaning brush support using any means including clamps, adhesives, or securing screws.

The squeegee blade support 42 is mounted on the lower surface of the manifold. The squeegee blade support 42 holds a squeegee blade 44 for removing liquid from the surface of a window after the window has been sprayed and scrubbed. The squeegee blade 44 may be held in place on the squeegee blade support 42 by any appropriate means including friction fit into a groove on the top of the squeegee blade support 42, clamps, screws or adhesives. Preferably the attachment method permits removing and replacing the squeegee blade 44 when the blade has become worn. It will be apparent from the foregoing description that the only difference between the washer heads 22 shown in FIG. 2 and in FIGS. 4–5 is the location and angling of the jets 46.

It is to be understood that the present invention is not limited to the embodiments described above, but encompasses any and all embodiments within the scope of the following claims.

I claim:

1. A window washing tool, comprising:

a hollow extension handle having an upper section and a lower section, the hollow handle defining a conduit;

means for connecting said extension handle to a water source;

a shutoff valve attached to the lower section of the handle for controlling water flow in the extension handle;

a cleaning solution reservoir and a cleaning solution control valve attached to the lower section of the handle downstream from the connecting means;

a washing head connected to the upper section of the extension handle, the washing head having a manifold for receiving water flow from the extension handle, the manifold having an upper surface and a lower surface, said surfaces being substantially planar and substantially parallel to each other;

a plurality of water jets disposed on the upper surface of the manifold;

an implement holder disposed on the upper surface of the manifold, the implement holder being adapted for holding a window cleaning implement;

a window cleaning implement mounted in said implement holder; and a squeegee blade attached to the lower surface of the manifold for removing water from a surface of a window.

2. A window washing tool comprising:

a hollow extension handle having an upper section and a lower section, the hollow handle defining a conduit;

means for connecting a water source to said extension handle;

a shutoff valve attached to the lower section of the handle for controlling water flow in the extension handle;

a cleaning solution reservoir and a cleaning solution control valve attached to the lower section of the handle upstream from the connecting means;

a washing head connected to the upper section of the extension handle, the washing head having a manifold for receiving water flow from the extension handle, the manifold having an upper surface and a lower surface;

an implement holder disposed on the upper surface of the manifold, the implement holder being adapted for holding a window cleaning implement;

a plurality of water jets disposed on the upper surface of the manifold, wherein the plurality of jets comprises a first plurality of jets positioned above the implement holder and a second plurality of jets positioned below the implement holder; and a squeegee blade attached to the lower surface of the manifold for removing water from a surface of a window.

3. The window washing tool of claim 2, wherein the second plurality of jets is directed substantially perpendicular to the manifold.

4. The window washing tool of claim 2, wherein the jets in the first plurality of jets are angled to direct water towards the top of an implement held in the implement holder.

5. The window washing tool of claim 1, wherein the extension handle comprises a plurality of telescoping sections.

6. The window washing tool of claim 1, wherein the extension handle comprises a plurality of separable piping sections.

7. The window washing tool of claim 1, wherein the solution control valve comprises a stopcock.

8. The window washing tool of claim 1, wherein the means for connecting said extension handle comprises a threaded connection on the lower section of the extension handle.

9. The window washing tool of claim 1, wherein the lower section of said extension handle has a portion defining a reduced cross-sectional area of the conduit, the cleaning solution reservoir being connected to said extension handle at the portion defining the reduced cross-sectional area, whereby the reduced cross-sectional area creates a pressure drop in water flow in said extension handle for drawing cleaning solution from the cleaning solution reservoir into said extension handle.

10. The window washing tool of claim 1, wherein said implement is selected from the group consisting of a cloth, a brush, and a sponge.

* * * * *